US008857402B2

(12) United States Patent
Nishihashi

(10) Patent No.: US 8,857,402 B2
(45) Date of Patent: Oct. 14, 2014

(54) ENGINE WITH VARIABLE VALVE TIMING MECHANISM

(71) Applicant: Suzuki Motor Corporation, Hamamatsu (JP)

(72) Inventor: Tomohiro Nishihashi, Hamamatsu (JP)

(73) Assignee: Suzuki Motor Corporation, Hamamatsu-Shi (JP)

( * ) Notice: Subject to any disclaimer, the term of this patent is extended or adjusted under 35 U.S.C. 154(b) by 0 days.

(21) Appl. No.: 13/902,172

(22) Filed: May 24, 2013

(65) Prior Publication Data

US 2013/0319355 A1 Dec. 5, 2013

(30) Foreign Application Priority Data

May 29, 2012 (JP) ..... 2012-121492

(51) Int. Cl.

| | |
|---|---|
| ***F02B 77/00*** | (2006.01) |
| ***F02F 7/00*** | (2006.01) |
| ***F01L 1/34*** | (2006.01) |
| *F01L 1/344* | (2006.01) |
| *F01L 1/053* | (2006.01) |
| *F01L 1/02* | (2006.01) |

(52) U.S. Cl.

CPC .. *F01L 1/34* (2013.01); *F01L 1/344* (2013.01); *F01L 2001/0537* (2013.01); *F01L 2001/34433* (2013.01); *F01L 1/022* (2013.01)

USPC ..... 123/195 C; 123/90.38

(58) Field of Classification Search

CPC ..... F02F 7/0073; F02F 7/0007

USPC ..... 123/90.38, 195 C, 90.15, 90.17

See application file for complete search history.

(56) References Cited

U.S. PATENT DOCUMENTS

| | | | | |
|---|---|---|---|---|
| 6,263,844 | B1 * | 7/2001 | Ozeki et al. | 123/90.17 |
| 8,042,508 | B2 * | 10/2011 | Kumagai et al. | 123/90.38 |
| 2009/0188465 | A1 * | 7/2009 | Iwata et al. | 123/195 C |
| 2013/0068191 | A1 * | 3/2013 | Takeuchi et al. | 123/195 R |
| 2013/0133611 | A1 * | 5/2013 | Koiwa | 123/195 C |

FOREIGN PATENT DOCUMENTS

| | | |
|---|---|---|
| JP | 2008-174116 A | 7/2008 |
| JP | 2008-215323 A | 9/2008 |

* cited by examiner

*Primary Examiner* — Thomas Denion
*Assistant Examiner* — Daniel Bernstein
(74) *Attorney, Agent, or Firm* — Stein IP, LLC

(57) ABSTRACT

There is provided an engine with a variable valve timing mechanism. A mount attachment part of a chain case is provided with a bracket attachment seat surface part to which a engine-side mount bracket is attached and is provided integrally with a hydraulic control valve attachment part below the bracket attachment seat surface part and in an inner side space part. A fastener part fastening the chain case to a cylinder head is disposed in the inner side space part of the mount attachment part and between the hydraulic control valve attachment part and the bracket attachment seat surface part.

3 Claims, 10 Drawing Sheets

ENGINE WITH VARIABLE VALVE TIMING MECHANISM

CROSS-REFERENCE TO RELATED APPLICATIONS

This application claims the benefit of Japanese Patent Application No. 2012-121492, filed May 29, 2012, in the Japanese Patent Office, the disclosure of which is incorporated herein by reference.

BACKGROUND OF THE INVENTION

1. Field of the Invention

The invention relates to an engine with a variable valve timing mechanism, and particularly, to an engine with a variable valve timing mechanism having a chain case that covers a timing chain.

2. Description of the Related Art

In an engine that is mounted on a vehicle, a chain cover that covers a timing chain is attached to an engine body having a cylinder block and a cylinder head. Also, an engine has been known which has a variable valve timing mechanism (VVT) changing valve timing. The variable valve timing mechanism attaches a hydraulic actuator to an end portion of a cam shaft that is pivotally supported by a cylinder head, attaches a hydraulic control valve to a chain case that covers a timing chain and operates the actuator in accordance with a supply state of an operating oil from the hydraulic control valve, thereby changing the valve timing.

Patent Document 1: JP-A-2008-174116

Patent Document 2: JP-A-2008-215323

In a chain case structure for an engine according to Patent Document 1, a chain case is provided with a hydraulic control valve attachment part to which a hydraulic control valve is attached and a mount attachment part that bulges in a crank axis line direction and a fastener part is arranged between the hydraulic control valve and the mount attachment part. An engine with a variable valve timing mechanism according to Patent Document 2 has a structure where a chain case is provided with a mount attachment part that bulges in a crank axis line direction, an intake-side hydraulic control valve attachment part and an exhaust-side hydraulic control valve attachment part and the intake-side hydraulic control valve attachment part and exhaust-side hydraulic control valve attachment part are connected to a side of the mount attachment part. Also, a fastener part that fastens the chain case to en engine body (cylinder head) is provided above the mount attachment part or intake-side hydraulic control valve attachment part and below an actuator cover part.

According to the structure of Patent Document 1, the hydraulic control valve attachment part is provided above the mount attachment part and the fastener part is provided below the hydraulic control valve attachment part. Therefore, when a bolt is inserted into the fastener part and is strongly (excessively) tightened, a periphery of the hydraulic control valve attachment part is deformed due to an axial force (or fastening force) of the bolt. Hence, distortion may occur between the hydraulic control valve attachment part and the hydraulic control valve, so that the operating oil may be leaked to an outside from a port of the hydraulic control valve. As a result, it is not possible to secure a sufficient oil pressure (operating oil pressure) when changing a phase of the variable valve timing mechanism, so that the speed (responsiveness) of changing a phase of the variable valve timing mechanism may be lowered. Also, according to the above structure, since the mount attachment part is formed below the hydraulic control valve attachment part and fastener part, the mount attachment part is positioned at a center of the chain case in a height direction. Therefore, when supporting the engine in a pendulum mount (suspension) manner, the mount attachment part approaches an elastic principal axis in a roll direction of the engine. Hence, it is difficult to suppress large torque (or high torque), which occurs upon acceleration of a vehicle, so that it is not possible to reduce vibrations of the engine.

According to the structure of Patent Document 2, the fastener part is arranged in a flat area becoming a valley between an actuator cover part and the mount attachment part (or intake-side hydraulic control valve attachment part). Therefore, when the bolt is inserted into the fastener part and is strongly (excessively) tightened, the flat area becoming a valley between the actuator cover part and the mount attachment part (or intake-side hydraulic control valve attachment part) is weakened, so that a periphery of the fastener part is deformed or distorted due to the axial force of the bolt. Furthermore, the distortion may occur around the hydraulic control valve attachment part. Also, an engine-side mount bracket is attached to an upper side of the intake-side hydraulic control valve attachment part. Therefore, when a vehicle travels or the engine drives, the load or vibration of the engine-side mount bracket is directly transferred to the intake-side hydraulic control valve attachment part, so that the periphery of the intake-side hydraulic control valve attachment part is deformed due to the vibration and the operating oil may be thus leaked from the port of the hydraulic control valve to the outside. As a result, it is not possible to secure a sufficient oil pressure (operating oil pressure) when changing a phase of the variable valve timing mechanism, so that the speed (responsiveness) of changing a phase of the variable valve timing mechanism may be lowered. Also, according to the above structure, since only leading end portions of the intake-side hydraulic control valve attachment part and exhaust-side hydraulic control valve attachment part are connected to the mount attachment part, a recess part is formed at an inner side of the mount attachment part. Therefore, the rigidity of the mount attachment part is not sufficient and the mount attachment part is apt to vibrate due to the vibrations of the engine, so that it is not possible to obtain an effect of sufficiently lowering the vibrations of the engine.

SUMMARY OF THE INVENTION

It is therefore an object of the present invention to provide an engine with a variable valve timing mechanism capable of preventing responsiveness of the variable valve timing mechanism from being lowered and reducing vibrations of the engine.

In order to achieve the above object, according to an aspect of the embodiments of the present invention, there is provided an engine with a variable valve timing mechanism including a cylinder block; a crankshaft rotatably supported by the cylinder block; a pair of intake and exhaust cam shafts rotatably supported by the cylinder head; a crank sprocket attached to the crankshaft; a pair of intake and exhaust cam sprockets attached to the intake and exhaust cam shafts; a timing chain wound onto the crank sprocket and the intake and exhaust cam sprockets; an actuator attached to at least one cam shaft of the intake and the exhaust cam shafts and configured to operate by an operating oil supplied from a hydraulic control valve to change a rotation phase of the cam shaft with respect to the crank shaft; and a chain case having both side portions in a width direction coupled to the cylinder block and the cylinder head and an upper end portion connected to a cylinder head cover, when the engine is seen in a crank axis line direction, and covering the timing chain, wherein the chain case is provided with an actuator cover part covering the actuator and bulging in the crank axis line direction along a mating surface with the cylinder, head cover, a mount attachment part bulging in the crank axis line direction below the actuator cover part and connecting to an engine-side mount bracket, and a hydraulic control valve attachment part having the hydraulic control valve attached therein, wherein a fastener part fastening the chain case to the cylinder head is provided adjacent to the hydraulic control valve attachment part. The mount attachment part is provided with a bracket attachment seat surface part to which the engine-side mount bracket is attached and is provided integrally with the hydraulic control valve attachment part below the bracket attachment seat surface part and in an inner side space part. The fastener part is disposed in the inner side space part of the mount attachment part and between the hydraulic control valve attachment part and the bracket attachment seat surface part.

According to the invention, it is possible to prevent the responsiveness of the variable valve timing mechanism from being lowered and to reduce the vibrations of the engine.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

In the accompanying drawings.

DETAILED DESCRIPTION OF THE EMBODIMENTS

Figure 1:
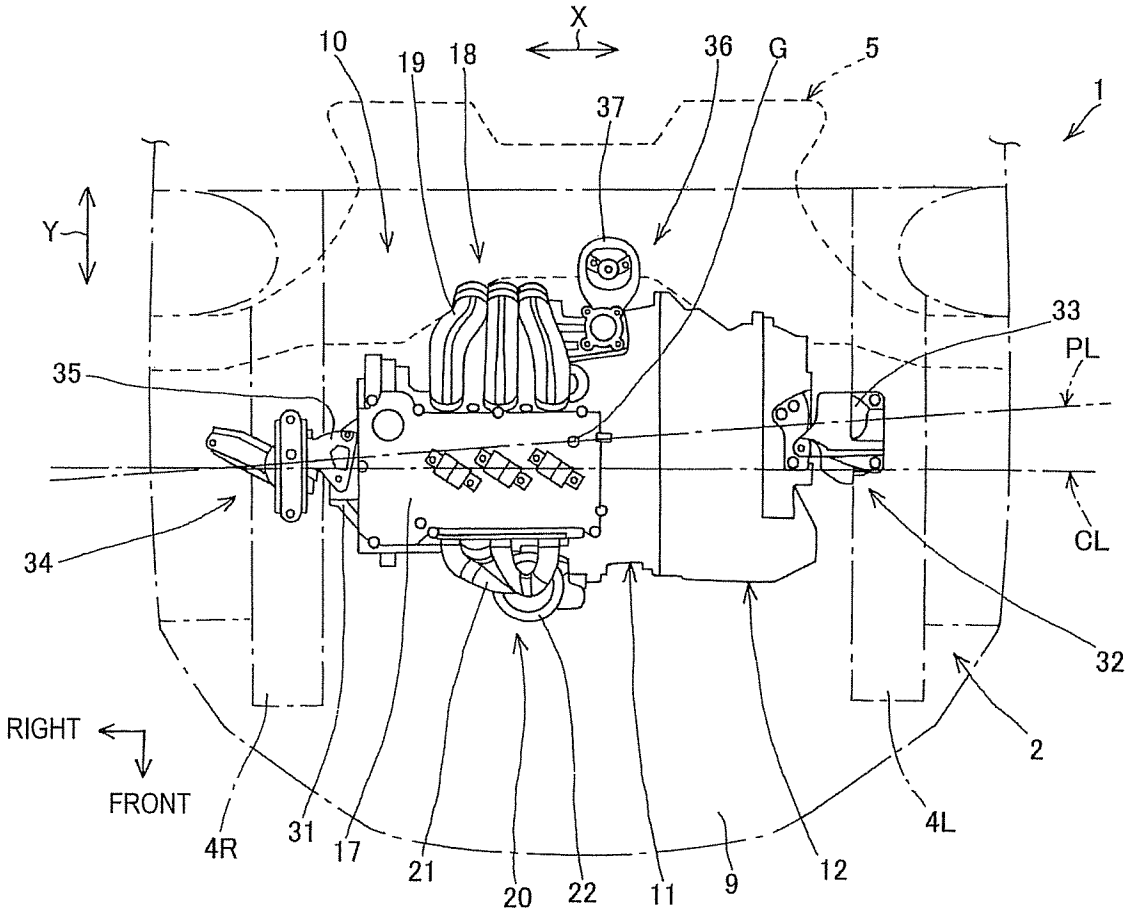
FIG. 1 is a plan view showing a front part of a vehicle (illustrative embodiment).

Reference will now be made in detail to the present embodiments of the present invention, examples of which are illustrated in the accompanying drawings, wherein like reference numerals refer to the like elements throughout. The embodiments are described below in order to explain the present invention by referring to the figures.

The invention realizes the object of preventing responsiveness of a variable valve timing mechanism from being lowered and reducing vibrations of an engine by integrating a mount attachment part and a hydraulic control valve attachment part.

ILLUSTRATIVE EMBODIMENTS

Figure 2:
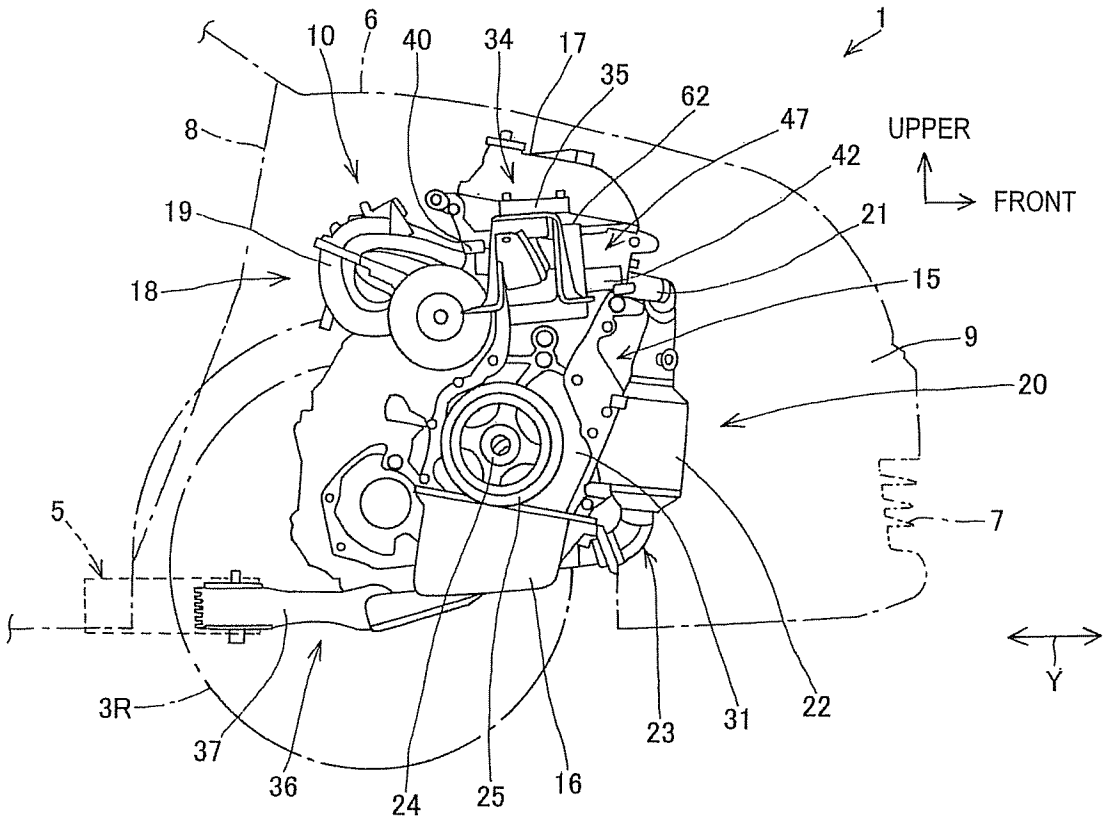
FIG. 2 is a right side view showing the front part of a vehicle (illustrative embodiment).
Figure 3:
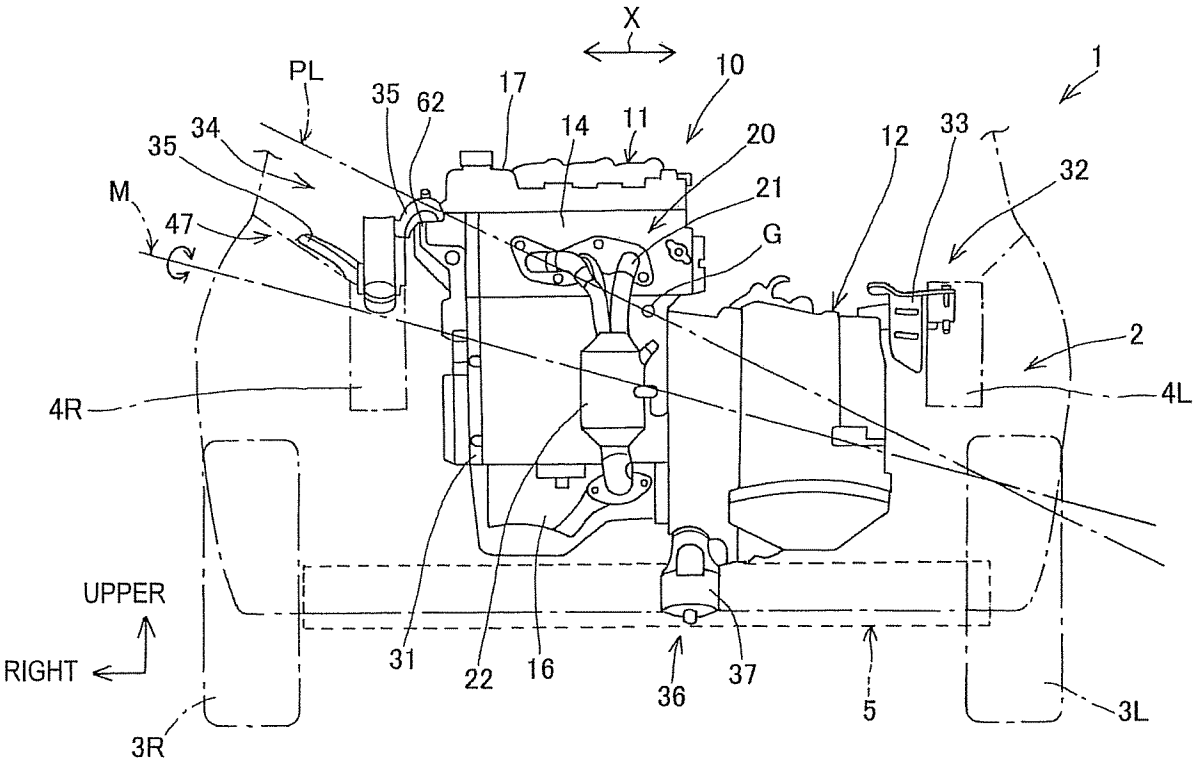
FIG. 3 is a front view showing the front part of a vehicle (illustrative embodiment).

FIGS. 1 to 11 show an illustrative embodiment of the invention. In FIGS. 1 to 3, a reference numeral '1' indicates a vehicle, a reference numeral '2' indicates a vehicle body, a reference numeral '3L' indicates a left-front wheel, a reference numeral '3R' indicates a right-front wheel, a reference numeral '4L' indicates a left side member, a reference numeral '4R' indicates a right side member, a reference numeral '5' indicates a sub-frame, a reference numeral '6' indicates an engine hood, a reference numeral '7' indicates a front grill, a reference numeral '8' indicates a dash panel and a reference numeral '9' indicates an engine room. In an engine room 9, a power unit 10 is arranged. The power unit 10 has a horizontally arranged engine 11, in which a crank axis line CL is directed in a vehicle width direction X, and a transmission 12 that is connected to a left end portion of the engine 11. The engine and the transmission are integrally configured. The engine 11 is a three-cylinder engine and includes an engine body 15 having a cylinder block 13 and a cylinder head 14 mounted on an upper part of the cylinder block 13, an oil pan 16 that is attached to a lower part of the cylinder block 13 and a cylinder head cover 17 that is attached to an upper part of the cylinder head 14. An intake apparatus 18 is provided at the rear of the cylinder head 14. The intake apparatus 18 has an intake manifold 19 that is disposed at the rear of the engine 11. Also, an exhaust apparatus 20 is provided to the front of the cylinder head 14. The exhaust apparatus 20 has an exhaust manifold 21 that is arranged at the front of the engine 11 and an exhaust pipe 23 that is connected to the exhaust manifold 21 and a catalyst 22 is attached thereto.

Figure 8:
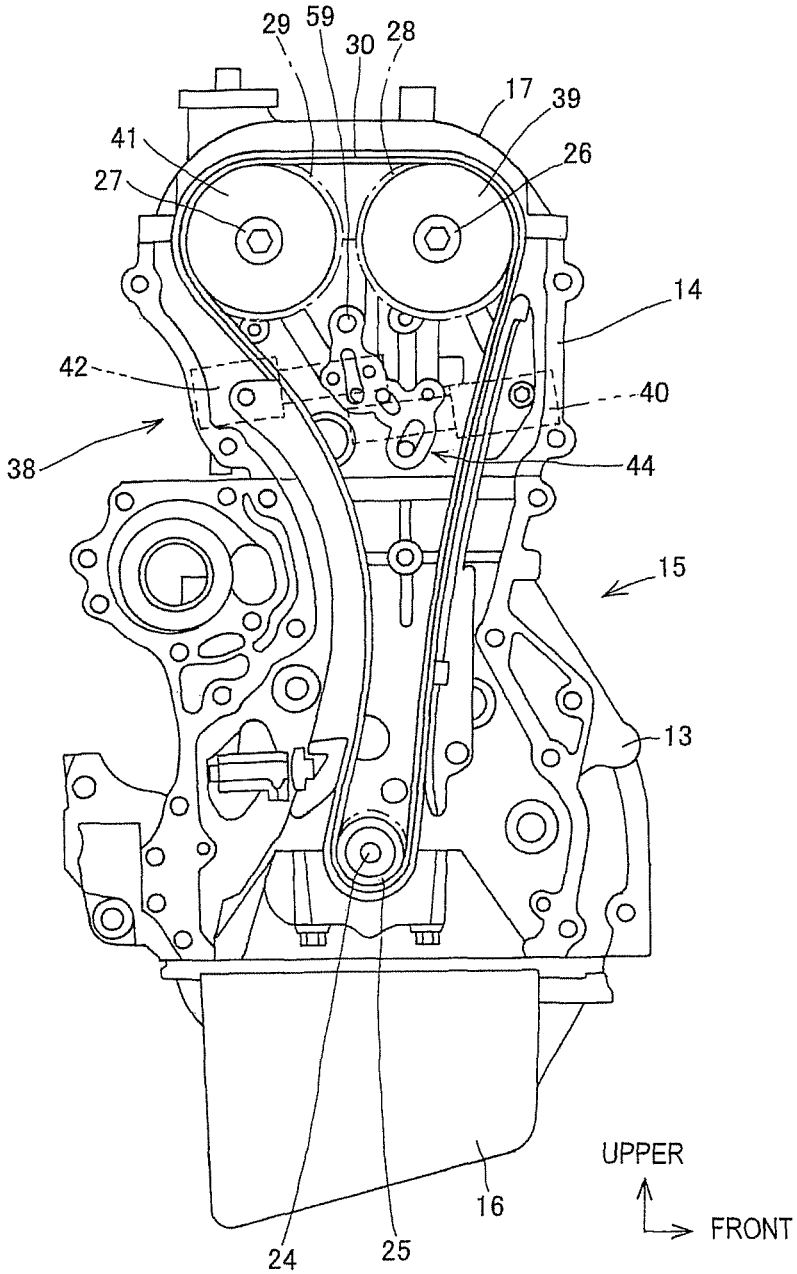
FIG. 8 is a side view of an engine in which the chain case is omitted (illustrative embodiment).

A crankshaft 24 is rotatably supported by the cylinder block 13. A crank sprocket 25 is attached to a right end portion of the crank shaft 24. An intake cam shaft 26 and an exhaust cam shaft 27 are rotatably supported by the cylinder head 14, as a pair of cam shafts. An intake cam sprocket 28 is attached to a right end portion of the intake cam shaft 26. An exhaust cam sprocket 29 is attached to a right end portion of the exhaust cam shaft 27. As shown in FIG. 8, a timing chain 30 is wound onto the crank sprocket 25, the intake cam sprocket 28 and the exhaust cam sprocket 29. A chain case 31 that covers the timing chain 30 is attached to a right end portion of the engine body 15. When the engine 11 is seen from the crank axis line CL, both side portions of the chain case 31 in a width direction are coupled to the cylinder block 13 and cylinder head 14 and an upper end portion thereof is connected to the cylinder head cover 17.

The power unit 10 is supported at its left side to a left side member 4L by a transmission-side mount bracket 33 of a transmission-side mount mechanism 32, is supported at its right side to a right side member 4R by an engine-side mount bracket 35 of an engine-side mount mechanism 34 and is supported at its rear side to the sub-frame 5 by a torque rod 37 of a rear side mount mechanism 36. Meanwhile, as shown in FIGS. 1 and 3, a center of gravity G of the power unit 10 is positioned at the engine 11-side on a power unit axis line PL.

Figure 6:
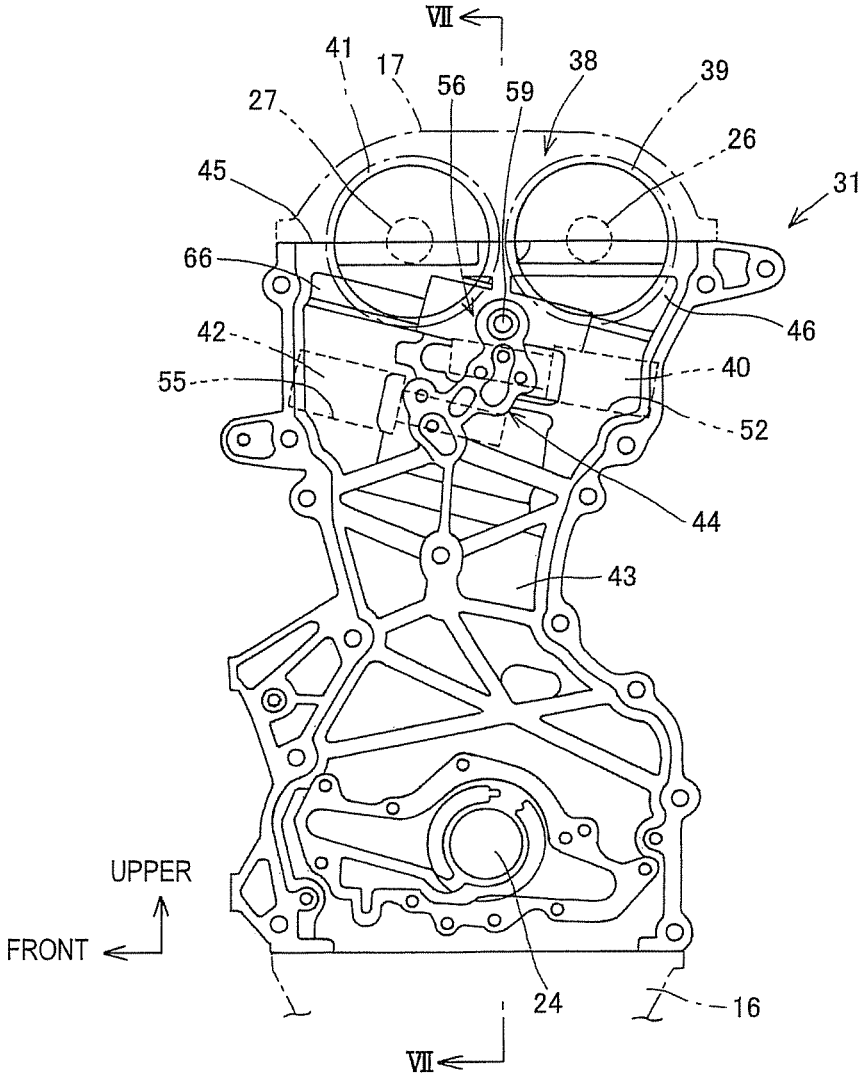
FIG. 6 is a view showing a chain case, which is seen from an engine body-side (inner wall surface-side) (illustrative embodiment).

The engine 11 is provided with a variable valve timing mechanism (VVT) 38. In the variable valve timing mechanism 38, an intake actuator 39 serving as the hydraulic actuator is attached to a right end portion of the intake cam shaft 26. The intake actuator 39 operates by an operating oil that is supplied from an intake hydraulic control valve 40 attached to the chain case 31 and changes a rotation phase of the intake cam shaft 26 with respect to the crank shaft 24. Also, an exhaust actuator 41 serving as the hydraulic actuator is attached to a right end portion of the exhaust cam shaft 27. The exhaust actuator 41 operates by operating oil that is supplied from an exhaust hydraulic control valve 42 attached to the chain case 31 and changes a rotation phase of the exhaust cam shaft 27 with respect to the crank shaft 24. As shown in FIG. 6, an inner surface wall 43 of the chain case 31 facing the engine body 5 is formed with an operating oil distribution circuit part 44 having a plurality of oil flowing holes.

Figure 7:
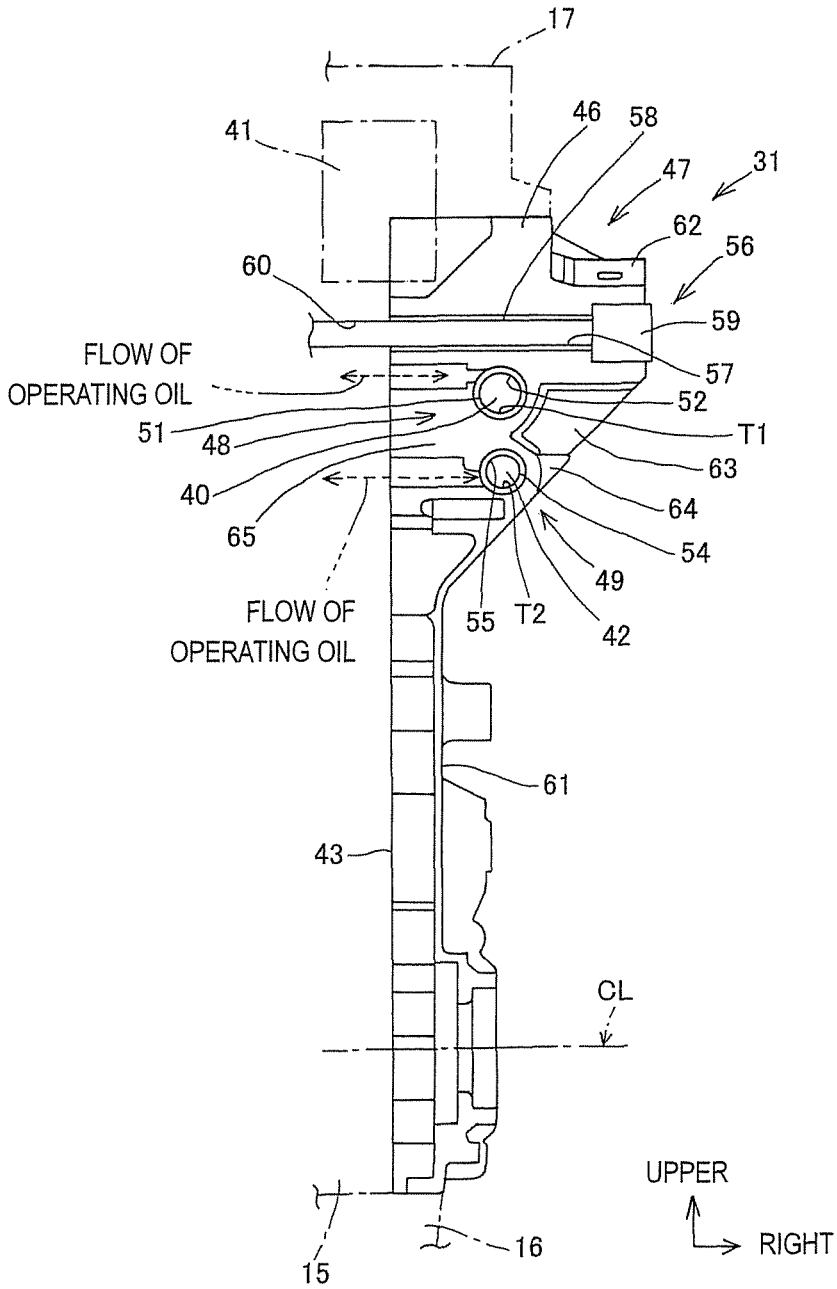
FIG. 7 is a sectional view of the chain case taken along a line VII-VII of FIG. 6 (illustrative embodiment).
Figure 9:
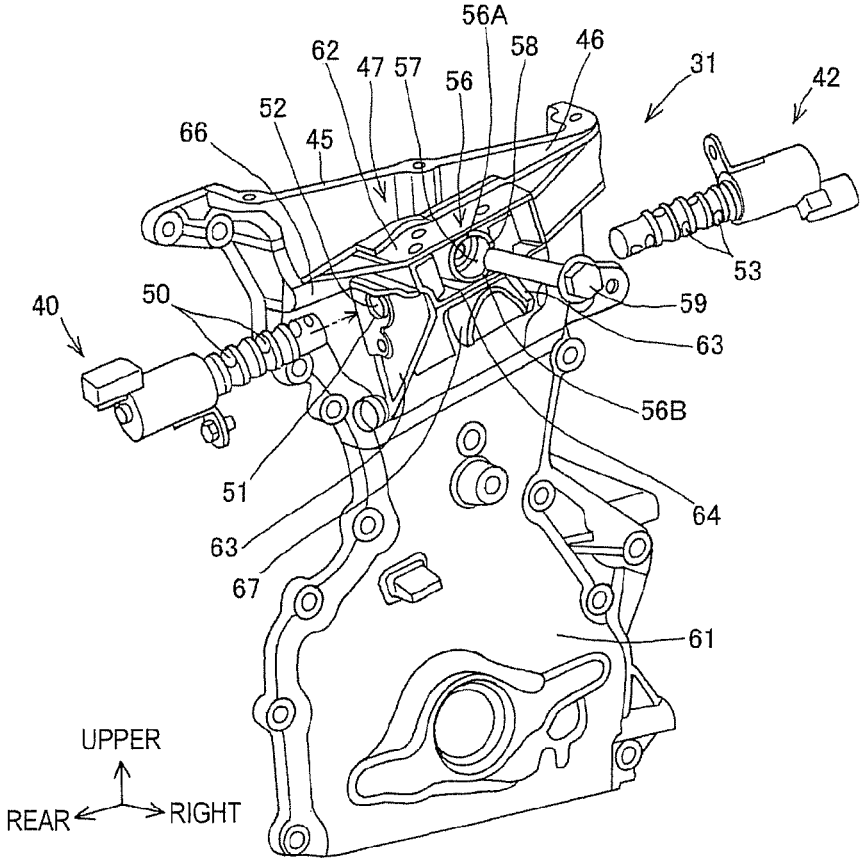
FIG. 9 is a perspective view of the chain case (illustrative embodiment).

As shown in FIGS. 7 and 9, the chain case 31 is integrally provided with an actuator cover part 46 that covers the intake actuator 39 and bulges in the crank axis line CL direction along a mating surface 45 with the cylinder head cover 17, a mount attachment part 47 that bulges in the crank axis line CL direction below the actuator cover part 46 and connects to the engine-side mount bracket 35 and intake-side hydraulic control valve attachment part 48 and exhaust-side hydraulic control valve attachment part 49 to which the intake hydraulic control valve 40 and the exhaust hydraulic control valve 42 are attached. The intake-side hydraulic control valve 40 has a plurality of intake-side oil ports 50 and is inserted into an intake-side hydraulic control valve attaching hole 52, which is formed at an intake-side hydraulic control valve attaching pipe part 51, from the vehicle rear of the intake-side hydraulic control valve attachment part 48. The exhaust-side hydraulic control valve 42 has a plurality of exhaust-side oil ports 53 and is inserted into an exhaust-side hydraulic control valve attaching hole 55, which is formed at an exhaust-side hydraulic control valve attaching pipe part 54, from the vehicle front of the exhaust-side hydraulic control valve attachment part 49. In this case, the intake-side hydraulic control valve attaching hole 52 and the exhaust-side hydraulic control valve attaching hole 55 are directed in a front-rear direction Y of the vehicle and are provided side by side in the upper-lower direction. Also, the intake-side hydraulic control valve attaching hole 52 is disposed above the exhaust-side hydraulic control valve attaching hole 55. Also, a fastener part 56 for fastening the chain case 31 to the cylinder head 14 is provided at a position adjacent to the intake-side hydraulic control valve attachment part 48 and the exhaust-side hydraulic control valve attachment part 49. The fastener part 56 has a bolt insertion pipe part 58 having a bolt insertion hole 57 formed thereto and a bolt 59 that is inserted into the bolt insertion pipe part 58. As shown in FIG. 7, the bolt 59 is screw-inserted into a bolt screw hole 60, which is formed in the cylinder head 14, via the bolt insertion hole 57. The bolt insertion pipe part 58 is provided to protrude rightwards from an outer wall surface 61 of the chain case 31.

As shown in FIGS. 7 and 9, the mount attachment part 47 has a bracket attachment seat surface part 62 to which the engine-side mount bracket 35 is attached and also integrally has the intake-side hydraulic control valve attachment part 48 and the exhaust-side hydraulic control valve attachment part 49 in an inner side space part 65 that is below the bracket attachment seat surface part 62 and is formed by a pair of vertical ribs 63, 63 and a horizontal rib 64. Also, the fastener part 56 is disposed in the inner side space part 65 of the mount attachment part 47 and between the intake-side hydraulic control valve attachment part 48 and the exhaust-side hydraulic control valve attachment part 49 and the bracket attachment seat surface part 62.

As described above, the mount attachment part 47 has the bracket attachment seat surface part 62 to which the engine-side mount bracket 35 is attached and also integrally has the intake-side hydraulic control valve attachment part 48 and the exhaust-side hydraulic control valve attachment part 49 in the inner side space part 65 that is below the bracket attachment seat surface part 62 and is formed by the pair of vertical ribs 63, 63 and the horizontal rib 64. By the above structure, the mount attachment part 47 and the hydraulic control valve attachment parts 48, 49 can be integrally formed, so that it is possible to increase the rigidity of the mount attachment part 47.

Also, as shown in FIGS. 7 and 9, the mount attachment part 47 has the bracket attachment seat surface part 62 to which the engine-side mount bracket 35 is attached and also integrally has the intake-side hydraulic control valve attachment part 48 and the exhaust-side hydraulic control valve attachment part 49 in the inner side space part 65 that is below the bracket attachment seat surface part 62 and is formed by the pair of vertical ribs 63, 63 and the horizontal rib 64. Also, the fastener part 56 is disposed in the inner side space part 65 of the mount attachment part 47 and between the intake-side hydraulic control valve attachment part 48 and the exhaust-side hydraulic control valve attachment part 49 and the bracket attachment seat surface part 62. By the above structure, the mount attachment part 47 having the high rigidity is formed with the fastener part 56 that fastens the central part of the chain case 31 in the width direction and the cylinder head 14, and the fastener part 56 is disposed between the hydraulic control valve attachment parts 48, 49 and the bracket attachment seat surface part 62. Therefore, it is possible to increase the rigidity of the periphery of the fastener part 56 by the mount attachment part 47 bulging from the chain case 31, the bracket attachment seat surface part 62, the hydraulic control valve attachment parts 48, 49 and the like.

Also, upon the fastening of the chain case 31 to the cylinder head 14, when the bolt 59 is inserted into the bolt insertion hole 57 of the fastener part 56 and the chain case 31 is attached to the cylinder head 14 through the inserted bolt 58, the rigidity of the periphery of the fastener part 56 is high, so that it is possible to prevent the periphery of the fastener part 56 from being deformed due to an axial force (or fastening force) of the bolt 59. Thereby, when the bolt 59 is tightened in the fastener part 56, the hydraulic control valve attachment pipe parts 51, 54 of the hydraulic control valve attaching holes 52, 55 into which the hydraulic control valves 40, 42 are inserted and the coupling parts at which the hydraulic control valves 40, 42 and the hydraulic control valve attachment parts 48, 49 are coupled are suppressed from being distorted. Hence, as shown in FIG. 7, it is possible to prevent the operating oil from being leaked from the ports 50, 53 of the hydraulic control valves 40, 42 to the outside through coupling surfaces T1, T2. The operating oil is prevented from being leaked from the ports 50, 53 of the hydraulic control valves 40, 4, so that it is possible to secure the sufficient oil pressure (operating oil pressure) when changing a phase of the variable valve timing mechanism 38. As a result, it is possible to obtain the effect of preventing the speed (responsiveness) of changing a phase of the variable valve timing mechanism 38 from being lowered.

The fastener part 56 is disposed in the inner side space part 65 of the mount attachment part 47 and between the hydraulic control valve attachment parts 48, 49 and the bracket attachment seat surface part 62, so that it is possible to provide the fastener part 56 just below the bracket attachment seat surface part 62 and just above the hydraulic control valve attachment parts 48, 49. Thus, when a vehicle travels or the engine 11 drives, even though the engine 11 vibrates and the bracket attachment seat surface part 62 of the mount attachment part 47 is thus pressed downwards or in a direction perpendicular to the crank axis line CL direction by the engine-side mount bracket 35, the deformation of the periphery of the bracket attachment seat surface part 62 or the mount attachment part 47 through the engine-side mount bracket 35 can be suppressed by the fastener part 56. Also, even when the load is input from the engine-side mount bracket 35 to the bracket attachment seat surface part 62 of the mount attachment part 47, it is possible to prevent the load from being directly transferred from the bracket attachment seat surface part 62 to the hydraulic control valve attachment parts 48, 49 by the fastener part 56. Thereby, it is possible to reduce the deformation or vibrations of the periphery of the bracket attachment seat surface part 62 and the entire mount attachment part 47, to stably keep the engine 11 through the mount attachment part 47 at the engine-side mount bracket 35 and to reduce the vibrations of the entire engine 11. Also, owing to the above reasons, it is possible to suppress the load, which is input to the bracket attachment seat surface part 62, from being transferred to the hydraulic control valve attachment parts 48, 49. Thus, when a vehicle travels or the engine 11 drives, it is possible to suppress the hydraulic control valve attaching holes 52, 55, into which the hydraulic control valves 40, 42 are inserted, or the coupling surfaces T1, T2, on which the hydraulic control valves 40, 42 and the hydraulic control valves attachment parts 48, 49 are coupled, from being distorted, thereby preventing the operating oil from being leaked from the ports 50, 53 of the hydraulic control valves 40, 42. Therefore, it is possible to improve the speed (responsiveness) of changing the phase of the variable valve timing mechanism 38.

As shown in FIGS. 6 and 9, the chain case 31 is formed with a step part 66 that erects from the outer wall surface 61 towards the actuator cover part 46. The fastener part 56 is arranged at the step part 66. Also, the bracket attachment seat surface part 62 is arranged at the actuator cover part 46 above the step part 66. By the above structure, it is possible to arrange the step part 66 at the chain case 31 at the same height position as the fastener part 56 in the upper-lower direction of the engine 11 and to increase the surface rigidity of the chain case 31 around the fastener part 56 by the step part 66. Thereby, even when the bolt 59 is inserted into the bolt insertion hole 57 and then screw-tightened into the bolt screw hole 60 of the cylinder head 14, it is possible to suppress the entire outer wall surface 61 of the chain case 31 from being deformed by the step part 66. As a result, it is possible to securely prevent the hydraulic control valve attaching holes 52, 55 of the hydraulic control valve attachment parts 48, 49 from being distorted. Also, the fastener part 56 is arranged at the step part 66, so that the bracket attachment seat surface part 62 formed above the fastener part 56 is pushed up above the step part 66 and is thus arranged at the actuator cover part 46. The bracket attachment seat surface part 62 is arranged at the higher position in the upper-lower direction of the engine 11, compared to the structure of the related art. Therefore, when the power unit 10 is held at the vehicle body 2 by a pendulum mount (suspension) manner, it is possible to securely arrange the bracket attachment seat surface part 62 (or engine-side mount bracket 35) at the higher position than an elastic principal axis in a roll direction, so that it is possible to arrange the bracket attachment seat surface part 62 (or engine-side mount bracket 35) at the upper part of the engine as far as possible from the elastic principal axis M in a roll direction. Thereby, it is possible to effectively suppress the large torque (or high torque), which is caused around the elastic principal axis M in a roll direction upon acceleration of the vehicle, so that it is possible to reduce the vibrations of the engine 11 (power unit 10) upon the acceleration of the vehicle.

Figure 10:
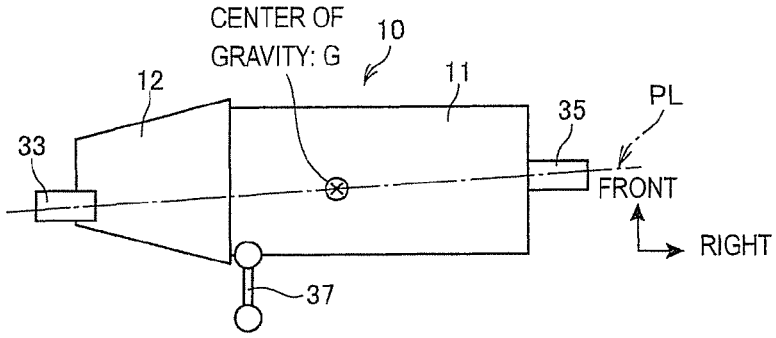
FIG. 10 is a plan view of a power unit illustrating a pendulum mount (suspension) manner (illustrative embodiment).
Figure 11:
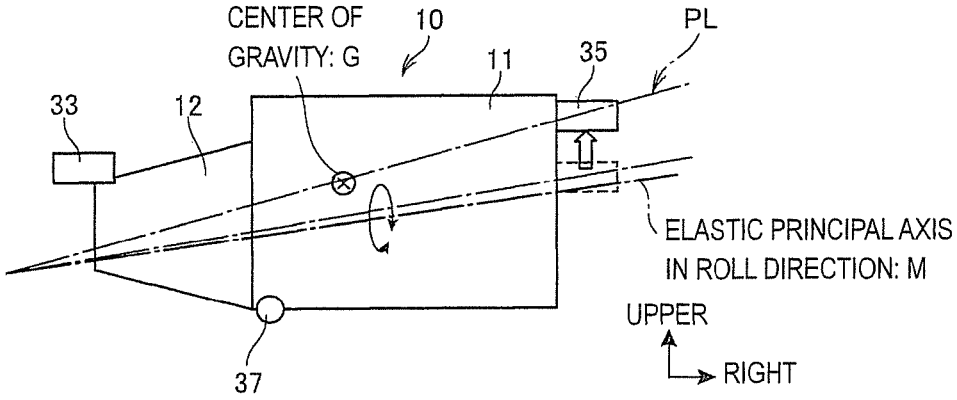
FIG. 11 is a rear view of the power unit illustrating the pendulum mount (suspension) manner (illustrative embodiment).

The technical background of the pendulum mount (suspension) manner serving as the structure of holding the power unit 10 is described in the below. As shown in FIGS. 10 and 11, as a premise, a center of rotation in a roll direction when the power unit 10 is mount-supported is referred to as the elastic principal axis M in a roll direction. Typically, a center of gravity G of the power unit 10 is positioned at the engine 11-side on the power unit axis line PL. Upon the acceleration of a vehicle, a reactive force is applied to the power unit 10, so that a large force (large torque) in a roll direction is generated for the power unit 10. Then, the power unit 10 intends to rotate around the elastic principal axis M in a roll direction. Therefore, in general, in the pendulum mount (suspension) manner, when the right engine-side mount mechanism 34 of the engine 11-side is arranged adjacent to the elastic principal axis M in a roll direction, it is difficult to support the large torque (high torque) that is generated around the elastic principal axis M in a roll direction. Hence, in order to suppress the large torque (high torque) upon the acceleration of a vehicle, it is preferable to separate the height position of the engine-side mount bracket 35 as far as possible from the elastic principal axis M in a roll direction, thereby supporting the power unit 10 to the vehicle 1. Thereby, when the engine-side mount bracket 35 is arranged at the upper, it is possible to hold the power unit 10 over a wide range by the engine-side mount bracket 35 and the torque rod 37, so that it is possible to effectively suppress the large torque upon the acceleration of a vehicle. On the other hand, if the engine-side mount bracket 35 is arranged adjacent to the elastic principal axis M in a roll direction, when the large torque (high torque) is generated upon the acceleration of a vehicle, the engine-side mount bracket is apt to rotate around the elastic principal axis M in a roll direction, so that it is disadvantageous to cope with the large torque.

Figure 4:
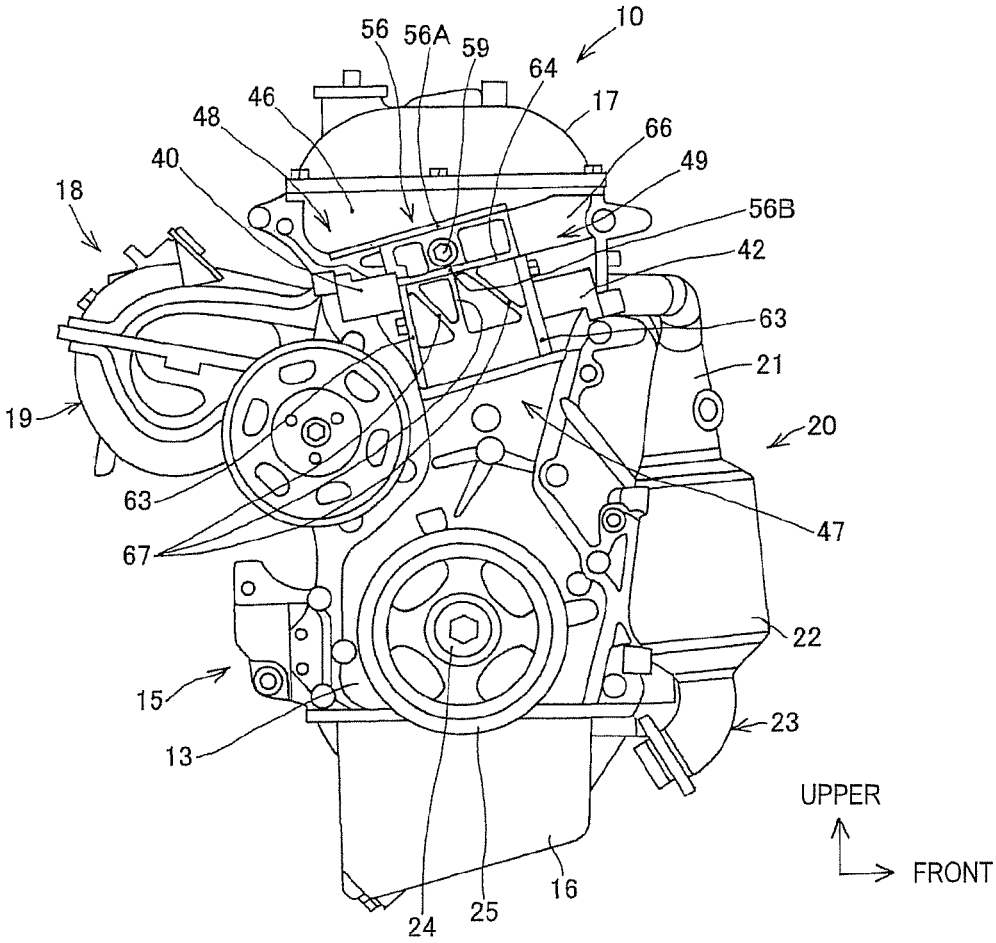
FIG. 4 is a side view of an engine (illustrative embodiment).
Figure 5:
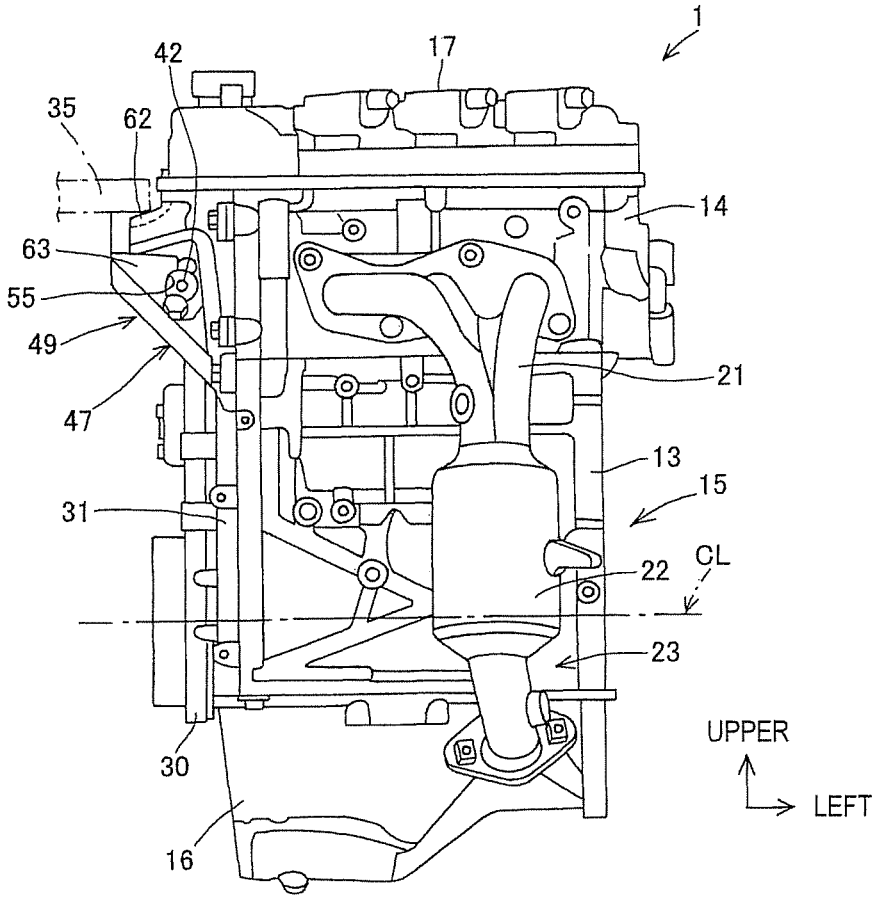
FIG. 5 is a front view of the engine (illustrative embodiment).

Also, as shown in FIGS. 4 and 9, the mount attachment part 47 has the pair of vertical ribs 63, 63, which extends in the upper-lower direction of the engine 10, on both side surfaces and the horizontal rib 64 that extends in the horizontal direction of the engine 11 and connects the vertical ribs 63, 63 therebetween. An upper end portion 56A of the fastener part 56 connects to the bracket attachment seat surface part 62. A lower end portion 56B of the fastener part 56 connects to the horizontal rib 64. The horizontal rib 64 is connected to a plurality of reinforcement ribs 67 extending downwards from the lower end portion 56B of the fastener part 56. By the above structure, it is possible to dispose the fastener part 56 in a space surrounded by the bracket attachment seat surface part 62, the vertical ribs 63, 63 and the horizontal rib 64, thereby connecting the bracket attachment seat surface part 62 and the horizontal rib 64 therebetween by the fastener part 56. Also, it is possible to surround the periphery of the fastener part 56 by the vertical ribs 63, 63, the horizontal rib 64 and the bracket attachment seat surface part 62, thereby further increasing the rigidity of the periphery of the fastener part 56. Also, since the plurality of reinforcement ribs 68 extending downwards from the horizontal rib 64 is added to the lower end portion 56B of the fastener part 56, it is possible to further increase the rigidity of the lower side of the fastener part 56, i.e., the rigidity of the hydraulic control valve attachment parts 48, 49-side. Thereby, when fastening the chain case 31 to the cylinder head 14 through the fastener part 56, it is possible to securely prevent the periphery of the fastener part 56 from being deformed and to reliably prevent the periphery of the hydraulic control valve attachment parts 48, 49 from being distorted due to the input load or vibration of the engine-side mount bracket 35.

The mount attachment part according to the invention can be applied to a variety of engines.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An engine with a variable valve timing mechanism comprising:

a cylinder block;

a crankshaft rotatably supported by the cylinder block;

a cylinder head mounted on an upper part of the cylinder block;

a pair of intake and exhaust cam shafts rotatably supported by the cylinder head;

a crank sprocket attached to the crankshaft;

a pair of intake and exhaust cam sprockets attached to the intake and exhaust cam shafts;

a timing chain wound onto the crank sprocket and the intake and exhaust cam sprockets;

an actuator attached to at least one cam shaft of the intake and the exhaust cam shafts and configured to operate by an operating oil supplied from a hydraulic control valve to change a rotation phase of the cam shaft with respect to the crank shaft; and a chain case having both side portions in a width direction coupled to the cylinder block and the cylinder head and an upper end portion connected to a cylinder head cover, when the engine is seen in a crank axis line direction, and covering the timing chain, wherein the chain case is provided with an actuator cover part covering the actuator and bulging in the crank axis line direction along a mating surface with the cylinder head cover, a mount attachment part bulging in the crank axis line direction below the actuator cover part and connecting to an engine-side mount bracket, and a hydraulic control valve attachment part having the hydraulic control valve attached therein, wherein a fastener part fastening the chain case to the cylinder head is provided adjacent to the hydraulic control valve attachment part, wherein the mount attachment part is provided with a bracket attachment seat surface part to which the engine-side mount bracket is attached and is provided integrally with the hydraulic control valve attachment part below the bracket attachment seat surface part and in an inner side space part, and wherein the fastener part is disposed in the inner side space part of the mount attachment part and between the hydraulic control valve attachment part and the bracket attachment seat surface part.

2. The engine with the variable valve timing mechanism according to claim 1, wherein the chain case is formed with a step part that erects from an outer wall surface thereof towards the actuator cover part, and wherein the fastener part is arranged at the step part and the bracket attachment seat surface part is arranged at the actuator cover part above the step part.

3. The engine with the variable valve timing mechanism according to claim 2, wherein the mount attachment part has vertical ribs extending in an upper-lower direction of the engine on both side surfaces thereof and a horizontal rib extending in a horizontal direction of the engine to connect the vertical ribs therebetween, and wherein an upper end portion of the fastener part is connected to the bracket attachment seat surface part, a lower end portion of the fastener part is connected to the horizontal rib and the horizontal rib is connected to a plurality of reinforcement ribs extending downwards from the lower end portion of the fastener part.

* * * * *